United States Patent [19]

Redecker et al.

[11] Patent Number: 5,043,031

[45] Date of Patent: Aug. 27, 1991

[54] POLYMER NITROAROMATIC COMPOUNDS AS PROPELLANTS

[75] Inventors: Klaus Redecker, Nuremberg; Rainer Hagel, Lichenfels, both of Fed. Rep. of Germany

[73] Assignee: Dynamit Nobel Aktiengesellschaft, Troisdorf, Fed. Rep. of Germany

[21] Appl. No.: 552,002

[22] Filed: Nov. 14, 1983

Related U.S. Application Data

[63] Continuation of Ser. No. 329,529, Dec. 7, 1981, abandoned, which is a continuation of Ser. No. 965,155, Dec. 1, 1978, abandoned.

[30] Foreign Application Priority Data

Dec. 1, 1977 [DE] Fed. Rep. of Germany ..... 2753555

[51] Int. Cl.[5] ..... C06B 45/10

[52] U.S. Cl. ..... 149/19.1; 149/92; 149/105; 102/431

[58] Field of Search ..... 149/19.1, 92, 105; 102/431

[56] References Cited

U.S. PATENT DOCUMENTS

| | | | |
|---|---|---|---|
| 3,020,261 | 2/1962 | Brown | 149/105 |
| 3,197,511 | 7/1965 | Tsou et al. | 149/105 |
| 3,450,778 | 6/1969 | Dacons I | 149/105 |
| 3,505,413 | 4/1970 | Shipp | 149/105 |
| 3,558,720 | 1/1971 | Schmidt-Collerus et al. | 149/105 |
| 3,755,471 | 8/1973 | Dacons II | 149/105 |
| 3,941,812 | 3/1976 | Gilbert | 149/105 |
| 3,953,259 | 4/1976 | Sayles | 149/105 |
| 4,145,969 | 3/1979 | Gawlick et al. | 149/105 |

*Primary Examiner*—Edward A. Miller

*Attorney, Agent, or Firm*—Antonelli, Terry, Stout & Kraus

[57] ABSTRACT

A method for producing a caseless propellant charge is disclosed wherein a polynitro polymer having an aromatic or heterocyclic ring is employed as a binder with a solvent and a propellant to produce an admixture and the admixture is molded into a shaped charge body.

6 Claims, No Drawings

POLYMER NITROAROMATIC COMPOUNDS AS PROPELLANTS

This application is a continuation, of application Ser. No. 329,529, filed Dec. 7, 1981, which is a continuation of application Ser. No. 965,155, filed Dec. 1, 1978, now abandoned.

The subject of the present invention concerns the use of polymer nitroaromatic compounds as propellants in pure form or in mixture with other propellants.

Propellants in the meaning of the present invention are such substances which are more particularly used for propulsion of projectiles. They are nevertheless also used for driving in bolts or for material deformation. Caseless charges have claimed special interest in recent times since they are accompanied by an essential saving of weight owing to the absence of the metal cartridge case in addition to a decrease in the number of operational sequences in comparison to the production of conventional ammunition.

Caseless propellant charges on a nitrocellulose base are well known by themselves. The handling of such types of caseless propellant charges presents, however, difficulties to the extent that the propellant compound easily breaks into pieces and forms crumblike particles. In addition, they do not have a sufficient resistance to moisture. In order to cope with these disadvantages, a method is described in DT-AS 17 96 283 in which the required stability of the propellant is increased by providing a wet, doughy poured propellant charge on a nitrocellulose base with a cellulose binding agent and subsequently allowed to harden.

A further disadvantage of caseless propellant charges on a nitrocellulose base is their low cookoff temperature of about 175° C. so that, when using nitrocellulose propellant charges in automatic weapons with a high firing rate, the cartridge chamber becomes so hot after a number of discharges that the propellant charge powder of a new cartridge passed into the chamber is cooked off by the heat. The consequences of this are, for example, irregularities or superelevation of the powder gas pressure as well as an uncontrollable influencing of the interior ballistic powder burnup leading to increased risks of accident. These disadvantages are also not removed by the method of the DT-AS 17 96 283.

For this reason, it has already been proposed to use secondary, finely-ground explosives with a high cookoff temperature (above ca. 200° C.) together with desensitizing binding agents as propellant charge powder for caseless ammunition. Such explosive-binder mixtures nevertheless reveal the disadvantage in the case of a high binding agent proportion required for the sufficient stability of the caseless propellant charges such that the burning only progresses on a hesitating basis as a result of the desensitizing effect of the binding agent, thereby allowing no satisfactory pressure buildup in the cartridge chamber. Further, there is also a disadvantage in the fact that unacceptable quantities of unburned reaction products, for example soot, also remain in the barrel of the weapon since the heat of explosion and the oxygen value of the propellant are quite severely reduced by increased quantities of binding agent. It has also already been proposed to cope with these disadvantages by producing porosity in the propellant compound. Nevertheless, the stability of the shaped propellant is herewith again disadvantageously decreased by this measure.

There is now the task of improving the stability of porous and shaped propellants without increasing the proportion of solid combustion residues when firing. Further, the binding agent used for this purpose should not have a desensitizing effect and be stable at temperatures over 200° C. A further condition for the substance to be used is the requirement that the ready propellant should generate a pressure in the weapon amounting to a maximum 4000 bar in the case of a secondary volume with a maximum 3000 $mm^3$.

In satisfaction of this task, it was now found that polymers on the bases of polynitrated aromatic compounds and/or heterocyclic compounds (in the following also characterized as polymer polynitroaromatic compounds) can be used as propellants. Such propellants do not have a desensitizing effect, are stable at temperatures above 200° C., also have a simultaneous effect as binding agent and additionally improve still more the interior ballistic properties of the whole propellant.

There can additionally be added to the new propellants a minimum proportion of a binder with desensitizing effect which does not need to be sufficient for the required stability of the shaped propellant since, without or in the case of very little binding agent additions, the burning can lead to reaction processes in the crystalline subareas of the explosive similar to detonation and which again have an unfavorable effect on the interior ballistics.

The polymer polynitroaromatic compounds used as high-temperature resistant propellants with binder characteristics are obtained by reaction of monomer dior trihalogen-polynitroaromatic compounds with metals, more particularly in the finely-divided form, according to independently well-known methods (Ullmann reaction). They are characterized by recurring structural units on the bases of nitrated mono- or polynuclear aromatic compounds. Their degree of polymerization ranges between 4 and 20 structural units.

Mononuclear structural elements are, for example, such as those on the basis of di- or trinitrobenzenes or the corresponding toluenes. Polynitrodiphenyls are named as exemplary structural elements of dinuclear polynitroaromatic compounds. The same is true for the corresponding diphenyls which are connected with one another by oxygen or an amino group or the group $$-NH-\underset{\underset{O}{\|}}{C}-\underset{\underset{O}{\|}}{C}-NH-.$$

The structural elements can also be the nitration products of heterocyclic compounds such as thiophene or pyrimidine, or even nitroaromatic compound-containing heterocyclic compounds such as, for example, tripicrylpyrimidine, dipicryl-thiophene and tripicryl-triazine. In addition, polynitrated polynuclear condensed aromatic compounds can be used as structural elements such as, for example, the nitration products of naphthalene, anthrazene, phenanthrene or acridone, acridine, phenazine, phthalazine, carbazole, benzothiazole or benzothiophene. The number of nitro groups in the individual nuclei is a function of the constitution of the aromatic or heterocyclic rings. They can range between 2 and 6. In the case of mononuclear structural elements, there are generally three nitro groups per structural unit. In the case of dinuclear structural elements, there are generally 4 or 6 nitro groups per structural unit.

Examples of monomers which are converted to polymer propellants according to the Ullmann reaction are styphnine acid dichloride or 3,3'-dichlorohexanitrodiphenyl. The condensates such as, for example, polynitropolyphenyl and which are obtained by reaction with, for example, copper powder are oligomers with ca. 4 to 11 nitrophenyl component parts.

The polymer polynitroaromatic compounds usable as propellants form films in the case of use with solvents especially after mixing with plasticizers following evaporation of the solvent. They can be mixed as inert plasticizers with conventional plasticizers such as, for example, phthalic acid esters of alcohols $C_1$ to $C_8$, sebazine acid esters, adipine acid esters and glycol acid esters or camphor. Further, explosive plasticizers such as, for example, nitration products of benzene or toluene can, however, also be used for improvement of heat of explosion and oxygen value.

The use of high-temperature resistant polymer polynitroaromatic compounds as propellants with binder character takes place in the manner that they, preferentially dissolved in a solvent, are uniformly distributed in a kneader with the given well-known propellants or propellant-filler mixture. Accordingly, the mixed material is extruded and the extrusion obtained are cut into granulate. If necessary, the polymer polynitroaromatic compounds are used together with a well-known binding agent having a desensitizing effect and a plasticizer.

The distribution can, nevertheless, also be undertaken such that the solvent dissolving the binders and plasticizers is added during the kneading process to a mixture of propellant, binder and filler previously divided by screening.

The well-known propellants which can be mixed with the high-temperature resistant polymer polynitroaromatic compounds are more particularly such with decomposition points above 200° C. Propellant mixtures can also be used. Numbered, for example, among the usable propellants are the well-known organic nitro compounds used for this operational purpose and which are derived from mono- or polynuclear nitrated aromatic compounds. Such nitrated aromatic compounds are, for example, the di- and triamino compounds of symmetrical trinitrobenzene as well as their acylation products such as, for example, 2,4,6,2',4', 6'-hexanitrooxanilide or 2,4,6,2',4',6'-hexanitro-N;N'-diphenylurea.

It is also possible to use nitrated aromatic compounds which are connected with another by carbon atoms or by atoms of sulfur, oxygen or nitrogen.

Examples of this type of compound are nitration products of diphenyldiphenylamine, 3,3'-diaminodiphenyl, diphenyloxide, diphenylsulfide or diphenylsulfone or stilbene such as, for example, hexanitrodiphenyloxide, hexanitrodiphenylsulfide, hexanitrodiphenylamine as well as 3,3'-azo-bis-(2,4,6,2',4',6'-hexanitrodiphenyl).

Also belonging to the high-temperature resistant propellants which can be used are heterocyclenes containing picryl residues such as thiophene, 1,3-thiazole, s-triazine or pyrimidine and nitrated heterocyclenes such as 1,3,6,8-tetranitrocarbazole,1,3,6,8-tetranitroacridone and, further, compounds such as tetranitro-2,3:5,6-dibenzo-1,3a,4,6a-tetraazapentalene.

Further, belonging here are also nitramines such as 1,3,5-trinitro-1,3,5-triazacyclohexane (cyclonite, RDX) and more particularly 1,3,5,7-tetranitro-1,3,5,7-tetraazacyclooctane (HMX) or nitric acid ester, for example, on the basis of aromatic, heterocyclic or aliphatic nitro compounds such as, for example, 2,4,6,2',4',6'-hexanitrodiphenylaminoethylnitrate or pentaerythritoltetranitrate.

HMX is preferred as a well-known propellant whereby it is possible by the use of polymer polynitroaromatic compounds in accordance with the invention to use additionally for reasons of safety a binder with desensitizing effect in the proportion of, for example, 5% and to achieve a solid binding of the mixture independently of the granular form of the propellant.

Suitable as additional binders with desensitizing effect are, for example, thermoplastic polymers such as, for example, polymers on the basis of acetalized polyvinyl alcohol whereby the acetalization is carried out with aldehydes having 1 to 6 C atoms and preferentially with butyraldehyde. Also suitable, however, are polyurethanes, polyesters, poly-(meth)-acrylate or cellulose esters.

Further, bifunctional monomers or reaction-capable oligomers or polymers can be used as desensitizing binding agents. During or after completion of the mixing with the propellant powder and the filler and the shaping, a radically performed crosslinkage or condensation can take place leading to a firm structure of the granular mixture.

The quantity of the additional binding agent having a desensitizing effect to be used is a function of the desired mechanical stability of the propellant compound and the contribution already performed for this purpose of the proportion of polymer polynitroaromatic compounds to be determined for thermodynamic reasons. The quantities of binding agents to be used are also a function of the type of distribution in the mixture of propellant and filler. If the distribution of the granulated substances takes place by screening the components, a lesser stability will also be achieved with higher shaping temperatures, for example molding temperatures, than when using the binders dissolved in a solvent. The relation of propellant to binding agent ranges in the latter case generally between 95:5 and 80:20.

The distribution of binding agents having a desensitizing effect in the propellant and, if necessary, the mixture of propellant and filler can be undertaken mechanically or preferentially by means of one of the solvents dissolving the binders. The use of a solvent dissolving the binders guarantees a uniform enclosure of the propellant and filler grain. The shaping and/or compression to solid propellant compounds follows the mixing process.

If polymer polynitroaromatic compounds are used as propellants with binder properties in accordance with the present invention, it follows that the weight ratio of the well-known propellants to the polymer polynitroaromatic compounds amounts to 99:1 to 50:50.

The manufacture of the shaped caseless propellant compounds generally takes place using the method whereby the powdered propellants with and without binder characteristic as well as, when necessary, independently well-known powdered fillers (for example, for porosity formation) and desensitizing binding agents are mixed by screening. The mixing can also take place with a fast-operating stirrer whereby one inert solvent such as, for example, gasoline or petroleum ether is appropriately used for each of the components in order to support the uniform distribution. In this case, the mixture is cleared of solvent after a successful uniform distribution, for example by filtering and subsequent drying. The uniform distribution of components can nevertheless also be undertaken in a kneader, if necessary with the assistance of a solvent for dissolving the binders. This type of performance is preferred.

The shaping to the desired molded bodies generally takes place by molding whereby the molding pressure ranges between 0.04 and 4 t/cm$^2$. At the same time, under molded bodies is also to be understood an extrusion from extrusion press or an extruder allowing use of the propellant/binder mixture as granulate, for example in the form of cylinders or small disks. This granulate can either be used in this way in conventional cartridge ammunition or preferentially made into a subsequent shaping, for example by molding into the desired caseless form.

The molding temperature is adapted to the binding agent used as well as the filler material. It always ranges under the temperature at which the filler can be thermally removed and under the temperature at which the propellant or propellant mixture or binding agent or binding mixture as the case may be become decomposed or thermally damaged.

The following will provide details of the invention on the basis of examples:

Example 1

Using screening or by means of a tumbler-mixer, a dry distributed mixture of 70 parts by weight α-HMX, 6.5 parts by weight polyvinyl-n-butyral, 4.9 parts by weight polynitropolyphenyl which was produced using the Ullmann reaction from styphnine acid dichloride and copper powder in nitrobenzene at 180° C. and 10.6 parts by weight ammonium hydrogen carbonate as filler, a mixture was made in the kneader which was 32 parts by volume ethylacetate, 4 parts by volume toluene and 4 parts by volume n-butylacetate and the mixture was kneaded for a period of 30 minutes. There then followed extrusion pressing in a cylindrical installation with a 70 mm diameter having 42 holes, each with a 1 mm diameter, and the cutting of the extrusions to a granulate, each having a length $<$ 1 mm.

Of this granulate, 0.998 g was weighed out each time and molded to propellant half-shells at a pressure of 1.8 t/cm$^2$. They possessed an impact strength of 1.91 N/cm after expelling the filler (4 hours at 100° C.). The ballistic data on firing is shown by the listing in Table 1.

Examples 2 to 4

The procedure was as in Example 1 although there was used 88 weight percentage α-HMX instead of 86 weight percentage and 4 weight percentage polynitropolyphenyl instead of 6 weight percentage with decreasing quantities of filler.

After molding the granulate at a pressure of 1.8 t/cm$^2$ and expelling the filler at 100° C., the propellant halves possessed an impact strength of 1.59 to 2.12 N/cm. The ballistic data show a somewhat increased maximum pressure in contrast to Example 1 and a slight lengthening of the firing time. In all cases, the propellant burned to the end with almost no residue.

Example 5 (Reference Example)

70 parts by weight α-HMX were distributed together with 6.1 parts by weight polyvinyl-n-butyral in 100 parts by weight water at ambient temperature using an Ultra-Turrax apparatus. Following this, water was removed by filtration and it was dried. The shaping to propellant compounds took place at a molding pressure of 1.8 t/cm$^2$ and a molding temperature of 100° C. for a period of 30 seconds. Following this, the molded objects possessed an impact strength of 1.70 N/cm. The firing data show overlong firing times with 2.22 milliseconds and great dispersions with a standard deviation of 43 m/sec (for comparison, Example 2 with 7 m/sec) which indicate nonuniform burning conditions as well as unburned propellant residues in the distance of 2 m from the muzzle and in the cartridge chamber. An addition of fillers leads to an unacceptable decrease in the stability of the propellant compounds.

Examples 6 and 7

Just as described in Examples 1 to 4, β-HMX was produced as propellant with polynitropolyphenyl and polyvinyl-n-butyral in the presence of ammonium hydrogen carbonate. Example 7 depicts a reference example without addition of polynitropolyphenyl.

The ballistic data are listed in the following table and show a satisfactory $p_{max}$ value with minimum standard deviation of velocity only in Example 6 with the simultaneous use of polynitropolyphenyl.

Example 8 (Reference Example)

83 parts by weight β-HMX were mixed by screening with 17 parts by weight polyvinyl-n-butyral and 4 parts by weight $KNO_3$. Since subsequently the propellant is shaped at 1.8 t/cm$^2$ and 100° C., ammonium hydrogen carbonate cannot be used as filler. For porosity production, $KNO_3$ is used and which is again dissolved at 35° C. by a 48-hour soaking of the molded objects. The firing results show that, by increasing the binder component, a similar effect as with addition of polynitropolyphenyl is not achieved. No values are received for t and v since the sabot separated from the core and the round traveled obliquely.

| Example No. | 1 | 2 | 3 | 4 | 5 | 6 | 7 | 8 |
|---|---|---|---|---|---|---|---|---|
| | I. COMPOSITION (Weight Percentage) | | | | | | | |
| α-HMX | 86 | 88 | 88 | 88 | 92 | — | — | — |
| β-HMX | — | — | — | — | — | 72 | 92 | 83 |
| Polynitropolyphenyl | 6 | 4 | 4 | 4 | — | 20 | — | — |
| Polyvinyl-n-butyral (contains 2 weight percentage dicyclohexylphthalate as plasticizer) | 8 | 8 | 8 | 8 | 8 | 8 | 8 | 17 |
| Filler (addition to 100 parts by weight propellant/binder mixture parts by weight) | 13 | 13 | 7 | 4 | — | 13 | 13 | 4 |
| Molding temperature (°C.) | 20 | 20 | 20 | 20 | 100 | 20 | 20 | 100 |
| Molding pressure (t/cm$^2$) | 1.8 | 1.8 | 1.8 | 1.8 | 1.8 | 1.8 | 1.8 | 1.8 |
| Stability of molded objects (impact strength N/cm) | 1.91 | 1.59 | 1.70 | 2.12 | 1.70 | — | — | — |

-continued

| Example No. | 1 | 2 | 3 | 4 | 5 | 6 | 7 | 8 |
|---|---|---|---|---|---|---|---|---|
| II. FIRING RESULTS FROM A HANDGUN WITH CALIBER 4.7 mm | | | | | | | | |
| Maximum pressure (bar) | 3926 | 4138 | 4109 | 3974 | 3644 | 3738 | 4545 | 4538 |
| Firing time (millisec) | 1.27 | 1.80 | 1.83 | 1.70 | 2.22 | 1.81 | 1.43 | — |
| Velocity after 5 m) (m/sec) | 957 | 962 | 981 | 981 | 969* | 920 | 985 | — |
| δ) = standard deviation | | 7 | | 7 | 43 | 9 | — | |
| Secondary volume ($mm^3$) | 3000 | 3500 | 3100 | 3100 | 2700 | 3000 | 3500 | 3700 |

*Unburned propellant residues at a distance of 2 m from the muzzle and in the cartridge chamber.

We claim:

1. A propellant charge which comprises a shaped body of an admixture containing a propellant and a polynitro polymer having recurring structural units of an aromatic or heterocyclic ring directly connected to each other as a binder having propellant properties and being capable of forming a film when admixed with a plasticizer, said polymer containing at least two nitro groups on the ring and the heterocyclic ring having a hetero atom selected from the group consisting of oxygen, nitrogen and sulfur and the polymer having between four recurring structural units and twenty recurring structural units; the polymer being thermally stable above 200° C. and the propellant being a high temperature-resistant propellant having a decomposition temperature above 200° C.; the weight ratio of propellant to polymer being 99:1 to 50:50.

2. The propellant charge according to claim 1, wherein said polymer has an aromatic or heterocyclic ring which further contains, in addition to said nitro groups, a hydroxy, methyl, or methoxy group.

3. The propellant charge according to claim 1, wherein said polymer and propellant are further admixed with at least one of an additional binding agent, a plasticizer for said polymer, or a filler.

4. A propellant composition which contains a propellant and, as a binder, a polynitro polymer having recurring structural units of an aromatic or heterocyclic ring directly connected to each other, said polymer having propellant properties and being capable for forming a film when admixed with a plasticizer, said polymer containing at least two nitro groups on said aromatic or heterocyclic ring, the hetero atom of the heterocyclic ring being oxygen, nitrogen or sulfur, and said polymer having between four and twenty recurring structural units, said ring optionally being substituted in addition to the nitro groups with a hydroxy, methyl or methoxy group; said propellant having a decomposition temperature over 200° C. and the polymer being thermally stable above 200° C.; the weight ratio of propellant to polymer being 99:1 to 50:50.

5. The propellant charge according to claim 1, wherein said propellant is 1,3,5,7-tetranitro-1,3,5,7-tetraazacyclooctane.

6. The composition according to claim 4, wherein said propellant is 1,3,5,7-tetranitro-1,3,5,7-tetraazacyclooctane.

* * * * *